US006409575B2

(12) United States Patent
Ishizaki et al.

(10) Patent No.: US 6,409,575 B2
(45) Date of Patent: Jun. 25, 2002

(54) PROCESSING APPARATUS AND METHOD

(75) Inventors: Kazuo Ishizaki; Tatsuo Joji; Yoshifumi Ohtsu; Hiroyuki Itoh, all of Tokyo (JP)

(73) Assignee: TDK Corporation, Tokyo (JP)

( * ) Notice: Subject to any disclaimer, the term of this patent is extended or adjusted under 35 U.S.C. 154(b) by 14 days.

(21) Appl. No.: 09/733,936

(22) Filed: Dec. 12, 2000

(30) Foreign Application Priority Data

Jan. 13, 2000 (JP) ..... 2000-005052

(51) Int. Cl.[7] ..... B24B 49/00

(52) U.S. Cl. ..... 451/5; 451/8; 451/9; 451/41; 451/287; 451/288; 451/410

(58) Field of Search ..... 451/5, 8, 9, 41, 451/287, 288, 410

(56) References Cited

U.S. PATENT DOCUMENTS 4,914,868 A 4/1990 Church et al.
5,433,651 A * 7/1995 Lustig et al. ..... 451/6
6,010,538 A * 1/2000 Sun et al. ..... 756/345

FOREIGN PATENT DOCUMENTS

JP 2-95572 4/1990
JP 11-000863 1/1999
JP 11-213337 8/1999

OTHER PUBLICATIONS

U.S. application No. 09/742,060, Ishizaki et al., filed Dec. 22, 2000.

* cited by examiner

*Primary Examiner*—Joseph J. Hail, III
*Assistant Examiner*—Shantese McDonald
(74) *Attorney, Agent, or Firm*—Oliff & Berridge, PLC

(57) ABSTRACT

An apparatus main body has a surface plate, a vertical shaft and an arm coupled to the vertical shaft such that it can move in the vertical direction. A spline shaft is attached to the arm such that it can move in the vertical direction. A keeper for holding a workpiece is attached to the lower end of the spline shaft. A reference position sensor for detecting the position of the top surface of a reference base as a reference position and a workpiece dimension sensor for detecting the position of the top surface of the keeper as a position associated with a dimension of the workpiece are attached to the arm. During a process on the workpiece, the absolute dimension of the workpiece is recognized based on information detected by the sensors, and the processing operation is controlled such that the dimension will become a desired value.

10 Claims, 6 Drawing Sheets

PROCESSING APPARATUS AND METHOD

BACKGROUND OF THE INVENTION

1. Field of the Invention

The present invention relates to a processing apparatus and method for automatically performing processes such as polishing on workpieces made of ceramics or the like to form them into desired dimensions.

2. Description of the Related Art

Processing apparatuses for processing workpieces made of ceramics or the like include polishing apparatuses such as grinding, lapping and polishing apparatuses. Some of such processing apparatuses including polishing apparatuses have an automatic sizing function for automatically controlling a processing operation to form a workpiece into desired dimensions. For example, there are four types of conventional processing apparatuses having the automatic sizing function as described below.

A processing apparatus of a first type acquires a certain signal from a workpiece (e.g., the resistance of a resistor embedded in the workpiece) and recognizes the present state (thickness, the distance to a target position, etc.) of the workpiece based on the signal to control a processing operation.

A processing apparatus of a second type controls a processing operation based on only a signal from a machine control system (e.g., information on the directions of three orthogonal spindles and the rotating direction).

A processing apparatus of a third type controls a process by setting a processing time based on processing conditions, and the method of control depends on the judgement of the operator or know-how.

A processing apparatus of a fourth type recognizes a process starting position and controls a processing operation based on displacement from the same position.

Steps for a polishing process operation utilizing a processing apparatus of the third type will now be described with reference to the flow chart in FIG. 9 as an example of steps for a polishing process operation utilizing a polishing apparatus according to the related art. In the process operation, the dimensions of a workpiece is first measured, and a processing time is set in the processing apparatus according to the same (step S201). At this time, the processing time is set such that the dimensions of the workpiece become predetermined dimensions larger than desired dimensions in order to prevent the workpiece from being over-polished. Next, the workpiece is secured to a keeper for holding the workpiece (step S202). The keeper is then secured to the processing apparatus (step S203). Next, the workpiece is processed (step S204). The processing apparatus then determines whether the processing time has reached the set tome or not (step S205). If not (N), the process at step S204 is continued. If the processing time has reached the set time (step S205; Y), the process is stopped, and the dimensions of the workpiece are measured and evaluated (step S206). Next, it is determined whether the evaluation has been passed or not (step S207). If not (N), a processing time is newly set (step S208), and the process returns to step S204 to perform further processing. If the evaluation has been passed (step S207; Y), the process operation is terminated.

A processing apparatus of the first type has a problem in that it inevitably involves a pre-process to allow the acquisition of a signal from a workpiece. Further, some products cannot be processed using a processing apparatus of the first type.

A processing apparatus of the second or fourth type has a problem in that it becomes more costly as processing accuracy is improved because the accuracy of the machine control system (rigidity against a slide, temperature characteristics, etc.) must be improved in order to improve processing accuracy. A processing apparatus of the second or fourth type cannot be used as a processing apparatus such as a chemimechanical polishing (CMP) apparatus in which an elastic body such as a polishing cloth (pad) is interposed between a workpiece and a surface plate. In the case of a processing apparatus of the fourth type, it is essential to provide a step of comparing the data of the current processing position and the data of the process starting position in order to detect displacement from the process starting position, which results in a problem in that the number of processing steps is increased.

A processing apparatus of the third type has a problem in that the processing accuracy is low because it has significant variation of processing depending on the state of the surface plate, slurry and the like and the operator. Further, it has a problem in that a workpiece must be measured before and after processing without fail and in that it has low operating efficiency because the processing step (step S204) and measurement/evaluation step (S206) must normally be repeated two or more times as apparent from FIG. 9.

SUMMARY OF THE INVENTION

It is an object of the invention to provide a processing apparatus and method for automatically processing a workpiece into desired dimensions which make it possible to improve processing accuracy and efficiency without any need for a special pre-process.

A processing apparatus according to the invention comprises:

- a processing machine which performs a predetermined process on a workpiece;
- a first detector which detects a reference position;
- a second detector which detects a position associated with a dimension of the workpiece which changes as a result of the process; and
- a controller which recognizes the dimension of the workpiece based on the reference position detected by the first detector and the position detected by the second detector and controls the processing machine such that the dimension of the workpiece becomes a predetermined value.

In the processing apparatus according to the invention, the first detector detects the reference position; the second detector detects the position associated with the dimension of the workpiece which changes as a result of the process; and the controller recognizes the dimension of the workpiece based on the positions detected by the two detectors and controls the processing machine such that the dimension of the workpiece becomes the predetermined value.

The processing machine of the processing apparatus according to the invention may polish the workpiece.

The first detector and second detector of the processing apparatus according to the invention may be mounted on the same arm.

The first detector and second detector of the processing apparatus according to the invention may intermittently perform the detecting operation.

The controller of the processing apparatus according to the invention may recognize the dimension of the workpiece based on the result of detection performed plural times by the first detector and the second detector.

A processing method according to the invention is a method for processing a workpiece utilizing a processing apparatus having a processing machine which performs a predetermined process on the workpiece, a first detector which detects a reference position and a second detector which detects a position associated with a dimension of the workpiece which changes as a result of the process, the method comprising the steps of:

detecting the reference position with the first detector and detecting the position associated with the dimension of the workpiece which changes as a result of the process with the second detector;

recognizing the dimension of the workpiece based on the reference position detected by the first detector and the position detected by the second detector; and performing the process by controlling the processing machine based on the recognized dimension such that the dimension of the workpiece becomes a predetermined value.

In the processing method according to the invention, the processing machine may polish the workpiece.

In the processing method according to the invention, the first detector and second detector may be mounted on the same arm.

In the processing method according to the invention, the detecting step may intermittently detect the positions.

In the processing method according to the invention, the recognizing step may recognize the dimension of the workpiece based on the result of detection performed plural times by the first detector and the second detector.

Other objects, features and advantages of the invention will become sufficiently apparent from the following description.

DETAILED DESCRIPTION OF THE PREFERRED EMBODIMENT

An embodiment of the invention will now be described in detail with reference to the drawings.

Figure 1:
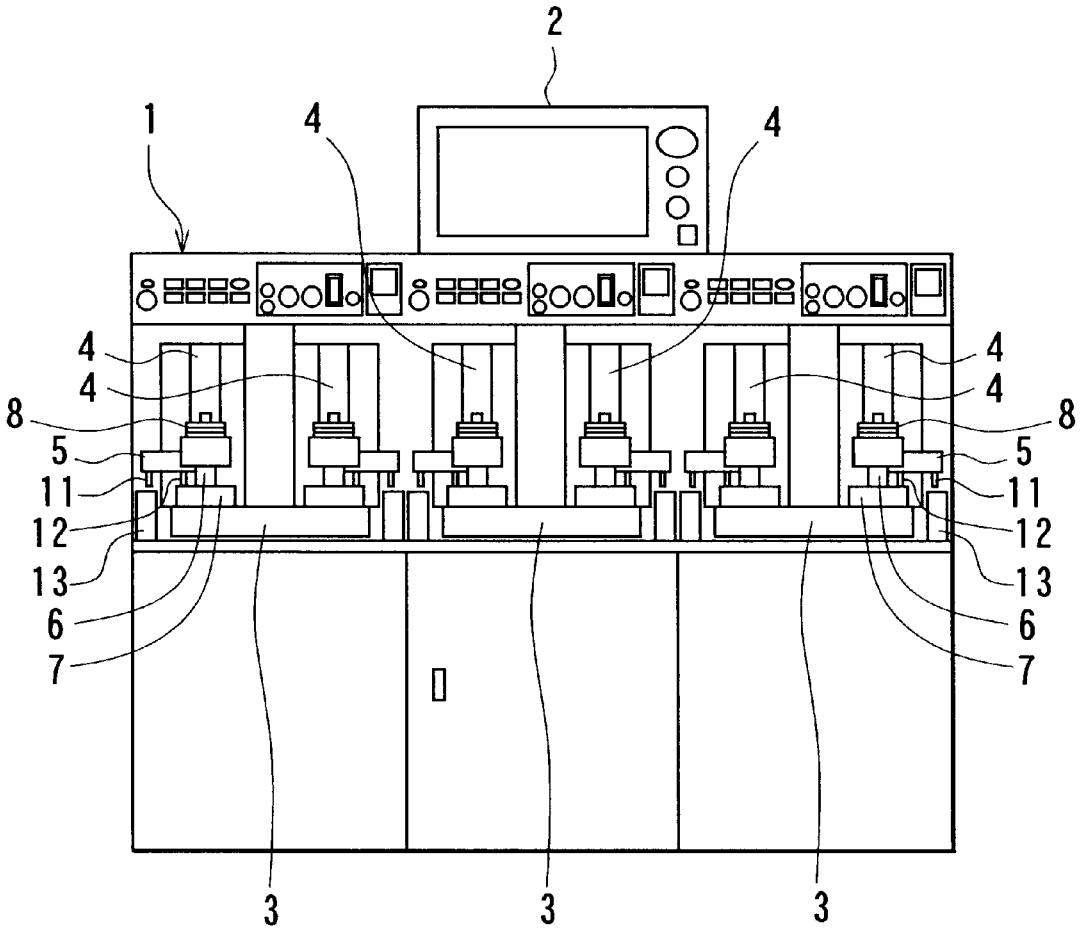
FIG. 1 is a front view of a processing apparatus according to an embodiment of the invention showing a general configuration thereof.
Figure 2:
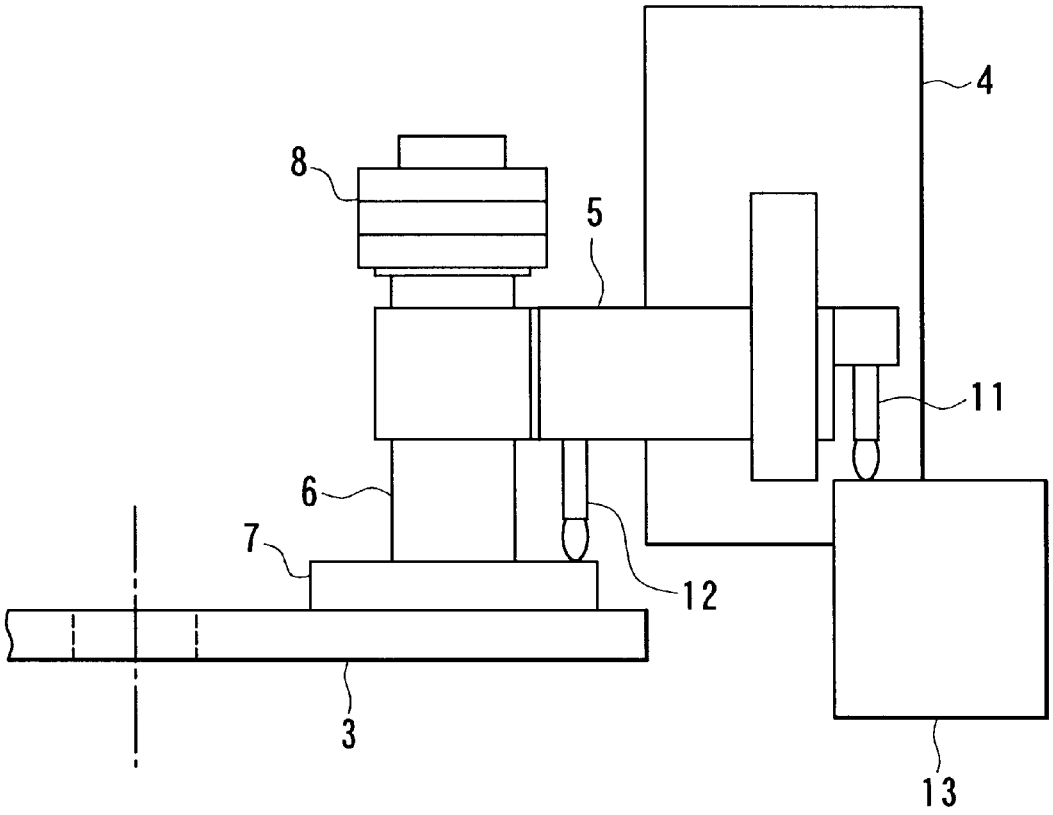
FIG. 2 is a front view of a major part of the processing apparatus according to the embodiment of the invention showing a state thereof during an adjusting operation.
Figure 3:
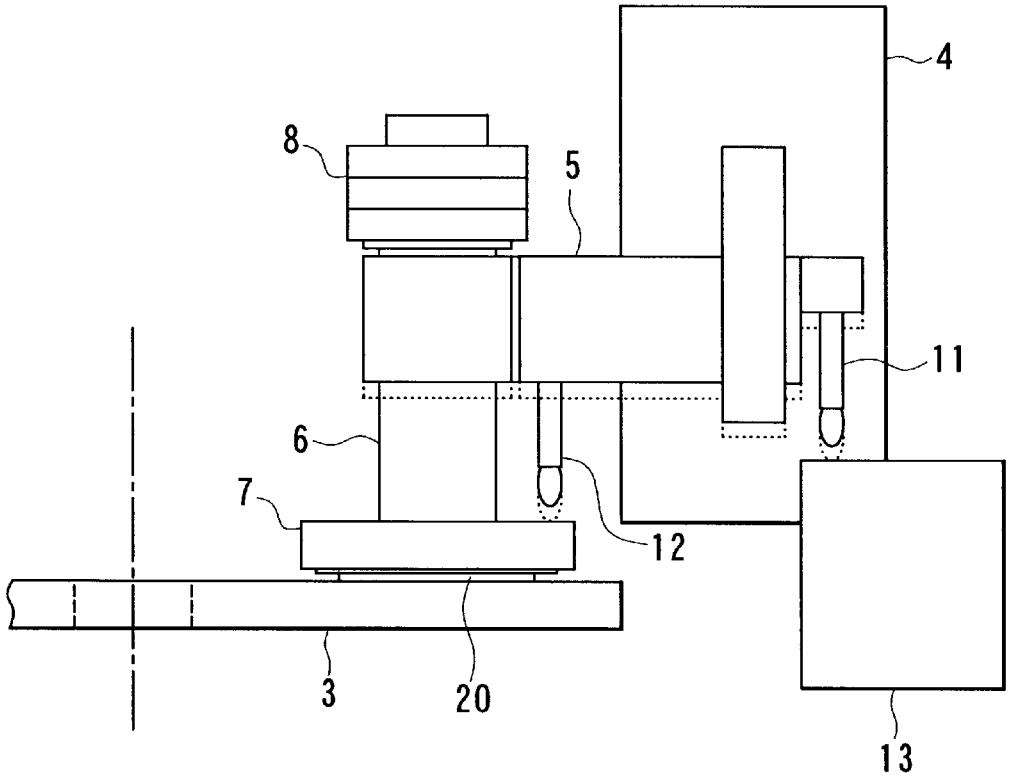
FIG. 3 is a front view of the major part of the processing apparatus according to the embodiment of the invention showing a state thereof during a processing operation.

FIG. 1 is a front view of a processing apparatus according to an embodiment of the invention showing a general configuration thereof. Each of FIGS. 2 and 3 is a front view of a major part of the processing apparatus according to the embodiment of the invention. FIG. 2 shows a state during an adjusting operation, and FIG. 3 shows a state during a processing operation.

The processing apparatus according to the present embodiment has an apparatus main body 1 for performing a polishing process on workpieces and a control panel 2 for inputting information on the workpieces and processing conditions and showing various indications. The polishing process includes grinding, lapping and polishing. The apparatus main body 1 has three surface plates 3, two vertical shafts 4 provided on each of the surface plates 3 and an arm 5 provided on each of the shafts 4. The arms 5 are coupled to the vertical shafts 4 such that they can move in vertical and horizontal (forward and backward) directions.

Spline shafts 6 are attached to the arms 5 such that they can move in the vertical direction. Keepers 7 for holding workpieces are attached to the lower ends of the spline shafts 6. Weights 8 are attached to the spline shafts 6 in the vicinity of the upper ends thereof.

Reference position sensors 11 as the first detector which detects reference positions and workpiece dimension sensors 12 as the second detector which detects positions associated with dimensions of the workpieces which change as a result of a process are attached to the arms 5. In the present embodiment, the dimensions of the workpieces which change as a result of a process are the thicknesses of the workpieces. The reference position sensors 11 are provided in positions outside the periphery of the surface plates 3. The workpiece dimension sensors 12 are provided in positions above the keepers 7. Reference bases 13 in the form of blocks for indicating reference positions are provided under the reference position sensors 11. The reference position sensors 11 detect the positions of the top surfaces of the reference bases 13. The workpiece dimension sensors 12 detect positions of the top surface of the keeper 7 as the positions associated with the dimensions of the workpieces which change as a result of a process.

The reference position sensors 11 and workpiece dimension sensors 12 may be contact type sensors or non-contact type sensors. The "TESA Module" manufactured by TESA Corp. or the like may be used as the contact type sensor. The "Microsense" manufactured by ADE Corp. may be used as the non-contact type sensor. Sensors having good temperature characteristics are preferably used as the sensors 11 and 12 because there may be temperature changes in the vicinity of the sensors 11 and 12 during processing. For example, such sensors with good temperature characteristics include glass scale type sensors (e.g., sensors manufactured by Union Tool Corp.).

Figure 4:
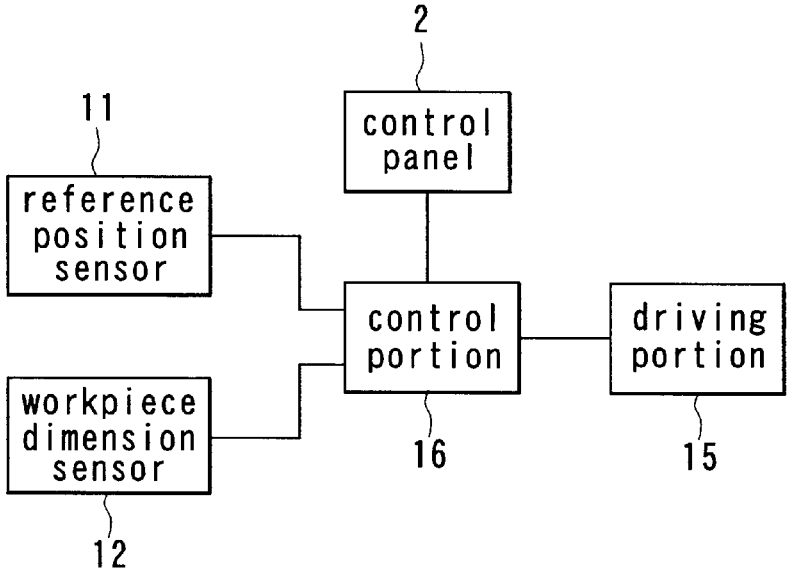
FIG. 4 is a block diagram showing a circuit configuration of the processing apparatus according to the embodiment of the invention.

FIG. 4 is a block diagram showing a circuit configuration of the processing apparatus according to the present embodiment. FIG. 4 shows only parts associated with one of the arms 5. As shown in FIG. 4, the processing apparatus has a driving portion 15 for driving the surface plate 3 and arm 5, and a control portion 16 for controlling the driving portion 15. The control panel 2, the reference position sensor 11 and the workpiece dimension sensor 12 are connected to the control portion 16. The control portion 16 controls the driving portion 15 according to information on the workpiece, processing conditions, etc. input from the control panel 2 and controls the driving portion 15 such that a dimension of the workpiece becomes a predetermined value by recognizing the dimension of the workpiece based on a reference position detected by the reference portion sensor 11 and a position detected by the workpiece dimension sensor 12. The control portion 16 also causes the control panel 2 to display information of the dimension of the workwpiece and so on thus recognized. For example, the control portion 16 is constituted by a computer. The control portion 16 corresponds to the controller of the present invention.

A description will now be made on an operation of the processing apparatus according to the embodiment and a processing method according to the present embodiment. The processing apparatus according to the present embodiment performs an adjusting operation as described below before it processes a workpiece. As shown in FIG. 2, in the adjusting operation, the keeper 7 having a known reference thickness is attached to the lower end of the spline shaft 6, and the keeper 7 is put in contact with the top surface of the surface plate 3. Next, the reference position sensor 11 detects the position of the top surface of the reference base 13 as a reference position, and the workpiece dimension sensor 12 detects the position of the top surface of the keeper 7. The control portion 16 recognizes and memorizes the relative positional relationship between the reference position and the position of the top surface of the keeper 7 based on the information of the positions detected by the sensors 11 and 12. The surface plate 3 may be kept stationary or rotated when the adjusting operation is performed. However, it is preferable to rotate the plate 3 for the reason described later. The adjustment is not required to be carried out prior to each processing operation and may be carried out at an appropriate frequency.

For processing the workpiece, as shown in FIG. 3, the workpiece 20 held by the keeper 7 is put in contact with the surface plate 3, and the surface plate 3 is rotated to polish the workpiece 20. During the processing operation, the reference position sensor 11 detects the reference position, and the workpiece position sensor 12 detects the position of the top surface of the keeper 7. The control portion 16 recognizes the relative positional relationship between the reference position and the position of the top surface of the keeper 7 based on the information of the positions detected by the sensors 11 and 12. This positional relationship is compared with the positional relationship that has been recognized and memorized at the adjusting operation. The absolute dimension (thickness) of the workpiece 20 is thereby recognized.

Figure 5:
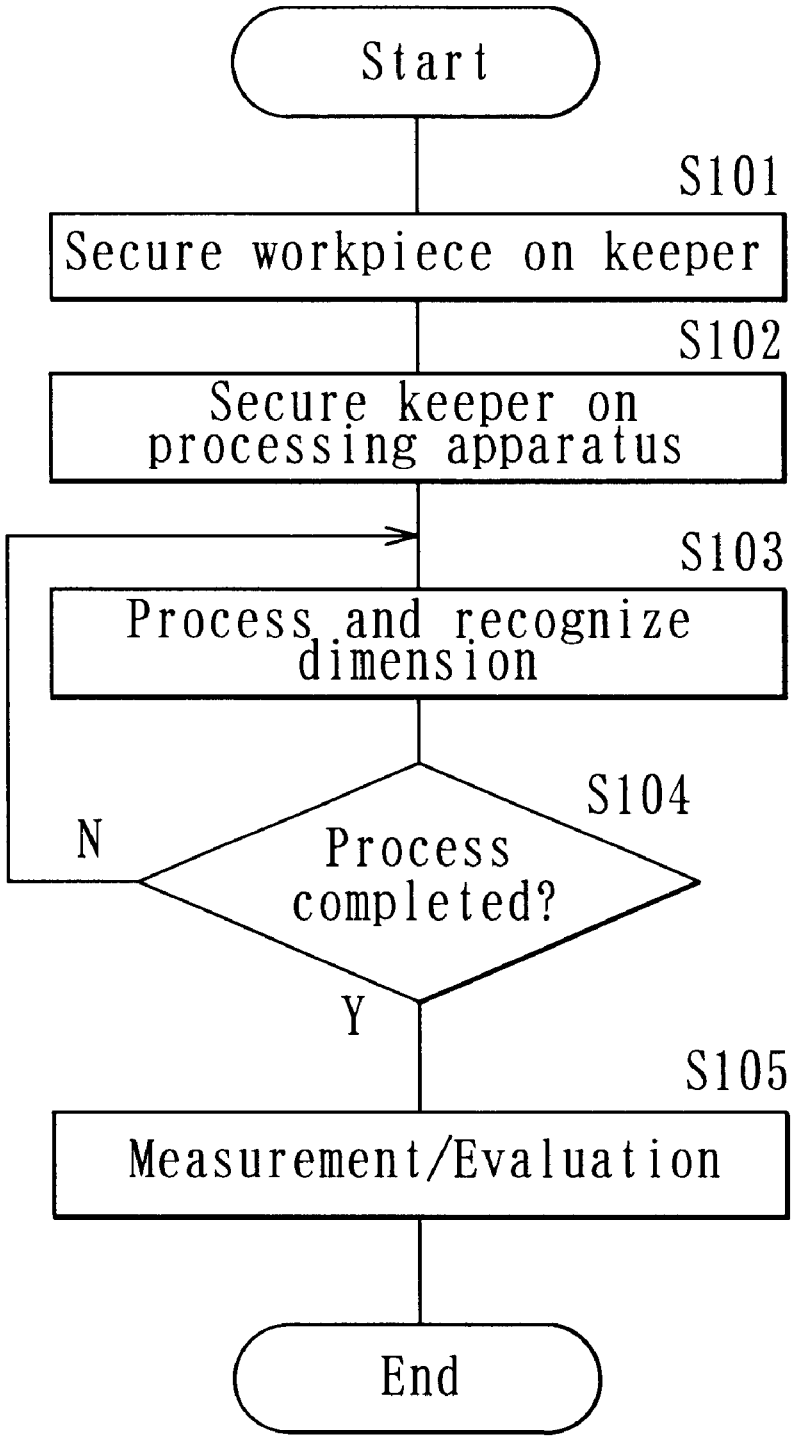
FIG. 5 is a flow chart of steps of the processing operation utilizing the processing apparatus according to the embodiment of the invention.

Steps of the processing operation will now be described with reference to the flow chart in FIG. 5 and to FIG. 3. During the processing operation, the workpiece 20 is first secured to the keeper 7 by means of thermal adhesion, vacuum absorption or the like (step S101). The thickness of the keeper 7 used here is the same as that of the keeper 7 used at the adjustment and is therefore known. The keeper 7 is then secured to the processing apparatus as shown in FIG. 3 (step S102). Then, information on the workpieces such as the length and the number of the workpieces 20 and processing conditions are input using the control panel 2. The input of processing conditions includes setting of a desired dimension of the workpiece 20 after the process. Next, a workpiece processing operation and a dimension recognizing operation are carried out (step S103). For the processing operation, the workpiece 20 held by the keeper 7 is put into contact with the surface plate 3, and the surface plate 3 is rotated to polish the workpiece 20. During the processing operation, the control portion 16 controls the driving portion 15 according to the input information and conditions and recognizes the dimension (thickness) of the workpiece 20 based on the reference position detected by the reference position sensor 11 and the position detected by the workpiece dimension sensor 12. Next, the control portion 16 determines whether the dimension of the workpiece 20 has reached the set dimension or not to determine whether to terminate the process or not (step S104). If the process is not to be terminated (N), the step S103 is continued. If the dimension of the workpiece 20 has reached the set dimension and the process is to be terminated (step S104; Y), the process by the processing apparatus is terminated. Finally, the dimension of the workpiece is measured and evaluated (step S105) to terminate the processing operation.

When the sensors 11 and 12 are non-contact type sensors, the position detection with the sensors 11 and 12 during the processing operation may be performed continuously or intermittently. When the sensors 11 and 12 are contact type sensors, the position detection with the sensors 11 and 12 during the processing operation is preferably performed intermittently to suppress the wear of the sensors 11 and 12. When the position detection with the sensors 11 and 12 is performed intermittently, as shown in FIG. 3, the arm 5 is moved up and down to put the sensors 11 and 12 in contact with the reference base 13 and keeper 7 only when the position detection is carried out.

When the position detection with the sensors 11 and 12 is performed intermittently, the cycle of detection may be shortened stepwise as the dimension of the workpiece approaches the set value.

When the dimension of the workpiece is measured based on the values detected by the sensors 11 and 12, the position detection with the sensors 11 and 12 may be performed plural times for each measurement to identify the dimension of the workpiece by carrying out a calculation using a statistic technique at the control portion 16 based on a plurality of detection values. This makes it possible to recognize the absolute dimension of the workpiece 20 with improved accuracy.

For example, during the rotation of the surface plate 3, swell of the surface plate 3 and keeper 7 may cause swell in the position of the top surface of the keeper 7. In order to prevent the dimension of the workpiece 20 recognized based on the values detected by the sensors 11 and 12 from changing as a result of the swell, the dimension of the workpiece 20 may be recognized as follows. First, the adjusting operation is performed with the surface plate 3 rotated. At this time, signals indicating rotating positions of the surface plate 3 are generated, and the timing of detection with the sensors 11 and 12 is determined based on the signal to perform the position detection with the sensors 11 and 12 at a plurality of rotating positions of the surface plate 3. Thus, the absolute position of the top surface of the keeper 7 including swell or the relationship between the rotating positions of the surface plates 3 and the absolute position of the top surface of the keeper 7 is recognized. For example, the relationship is expressed by a sine curve where the rotating positions of the surface plate 3 are plotted along the abscissa axis and the absolute position of the top surface of the keeper 7 is plotted along the ordinate axis. During the processing operation, the absolute position of the top surface of the keeper 7 including swell or the relationship between the rotating position of the surface plate 3 and the absolute position of the top surface of the keeper 7 is similarly recognized by performing the position detection with the sensors 11 and 12 in a plurality of rotating positions of the surface plate 3. For example, the relationship is also expressed by a sine curve. Then, the relationship recognized during the adjusting operation is compared with the relationship recognized during the processing operation, which makes it possible to accurately recognize the absolute dimension of the workpiece 20 from which any swell component has been removed. When the relationship recognized during the adjusting operation and the relationship recognized during the processing operation are compared, corresponding parts between the relationships may be accurately identified and compared with each other by correlating the two relationships (e.g., two sine curves) or by using other means.

Workpieces 20 to be processed by the processing apparatus according to the present embodiment include, for example, a material for a thin film magnetic head. The material will now be briefly described.

In general, a flying type thin film magnetic head used in a magnetic disk drive or the like is constituted by a slider formed with a thin film magnetic head element at the rear end thereof. In general, a slider has a rail portion whose surface serves as a medium facing surface (air bearing surface) and a taper portion or step portion in the vicinity of the end on an air inflow side thereof. The rail portion is slightly floated above the surface of a recording medium such as a magnetic disk by a stream of air that flows in through the taper portion or step portion.

In general, sliders are manufactured by cutting a wafer in one direction, the wafer having a plurality of rows of sections to become sliders (hereinafter referred to as slider sections) each including a thin film magnetic head element. Materials referred to as "bars" on which the slider sections are arranged in a row are thereby formed, and the bars are cut into sliders. A surface of a bar which is to become a medium facing surface (hereinafter referred to as "medium facing surface" for convenience) is subjected to processes such as lapping and formation of a rail portion. Such processes may be performed before or after the formation of the bar.

In the process of manufacturing a slider as described above, the final thickness of the slider or the profile of the medium facing surface may be controlled by lapping the surface of the bar opposite to the medium facing surface before or after the processing of the medium facing surface of the bar, or by lapping two surfaces of a block in which two rows of the slider sections are arranged with the medium facing surfaces thereof facing each other, the two surfaces of the block being opposite to the medium facing surfaces respectively. The processing apparatus according to the present embodiment may be used for lapping the surface of such a bar or block opposite to the medium facing surface.

As described above, with the processing apparatus or method according to the present embodiment, an absolute dimension of a workpiece is recognized, and a process is automatically performed such that the dimension of the workpiece becomes a predetermined value. This makes it possible to automatically process the workpiece such that it will have a desired dimension and to process the workpiece with high accuracy without any need for a special preprocess for allowing the acquisition of a signal from the workpiece.

In the present embodiment, there is provided the reference position sensor 11 for detecting a reference position and the workpiece dimension sensor 12 for detecting a position associated with a dimension of a workpiece that changes as a result of a process. The absolute dimension of the workpiece is recognized based on information detected by both of the sensors 11 and 12. Therefore, the present embodiment makes it possible to easily recognize the absolute dimension of the workpiece by comparing the information detected by the sensors 11 and 12 without any unnecessary improvement of the accuracy of a machine control system, which consequently makes it possible to improve processing accuracy.

Figure 9:
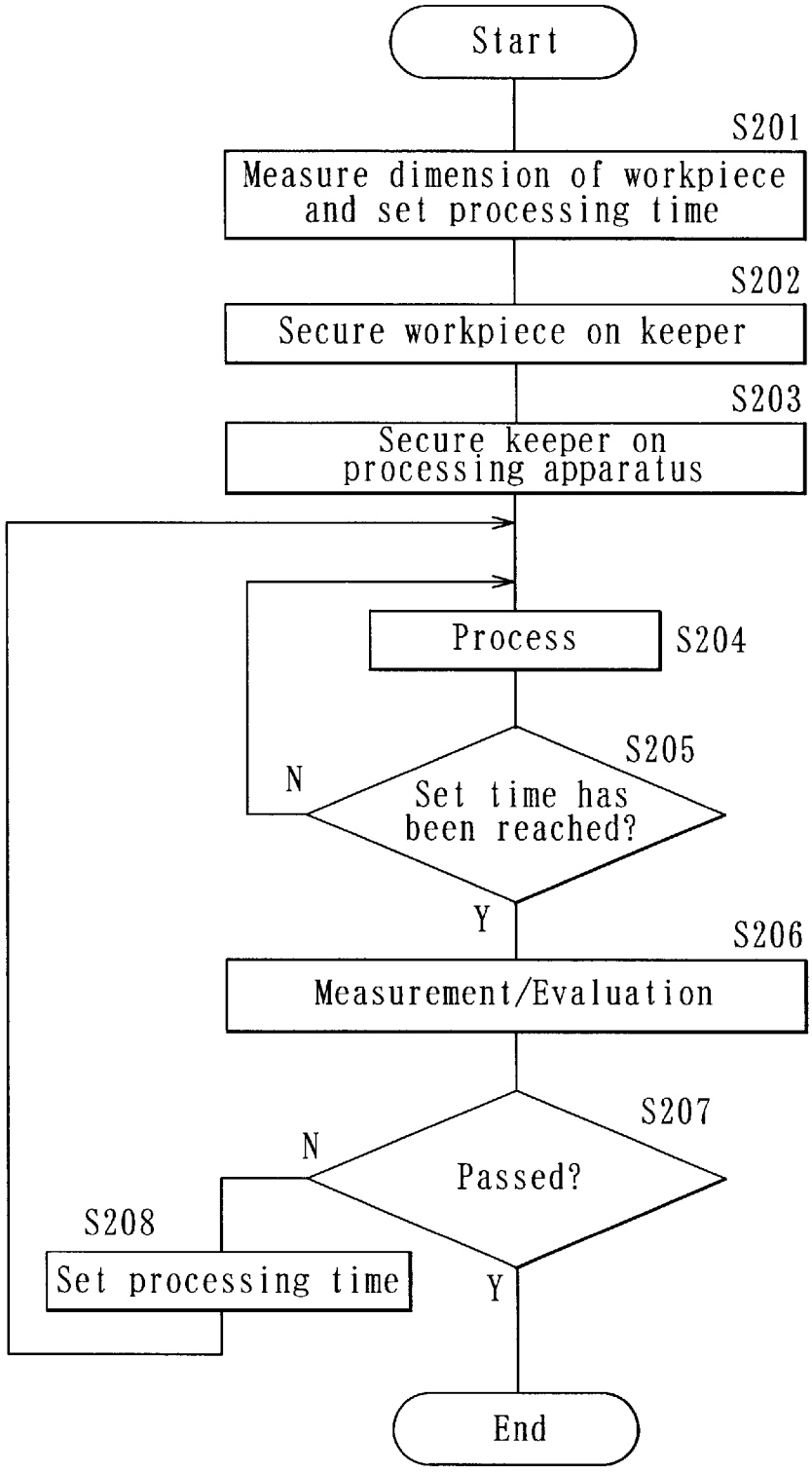
FIG. 9 RELATED ART
FIG. 9 is a flow chart showing an example of steps of a polishing process operation utilizing a polishing process apparatus according to the related art.

As shown in FIG. 9, when processing time is controlled to provide a workpiece with a desired dimension, operating efficiency is low because a processing step and a measurement/evaluation step are repeated two or more times. On the contrary, according to the present embodiment, the efficiency of a processing operation can be improved because accurate recognition of the absolute dimension of a workpiece makes it possible to provide the workpiece with a desired dimension at one processing step. For example, the present embodiment makes it possible to improve the efficiency of a processing operation by 1.5 times or more (in other words, to reduce the time of the processing operation to ⅔ or less) when compared to the case in which the processing time is controlled.

According to the present embodiment, since there is no need for measuring and setting dimensions of a workpiece prior to a process, there is no possibility of occurrence of measuring and setting errors by an operator. Further, since the present embodiment eliminates the need for a measurement and evaluation step in the middle of a process, it is possible to prevent any reduction of quality attributable to electrostatic discharge (ESD), corrosion, etc.

According to the present embodiment, the two sensors 11 and 12 can be kept in a constant positional relationship whether the surface plate 3 is stopped or rotated because the two sensors 11 and 12 are attached to the same arm 5. This allows a further improvement of the accuracy of recognition of the absolute dimension of a workpiece and makes it possible to improve processing accuracy further.

Figure 6:
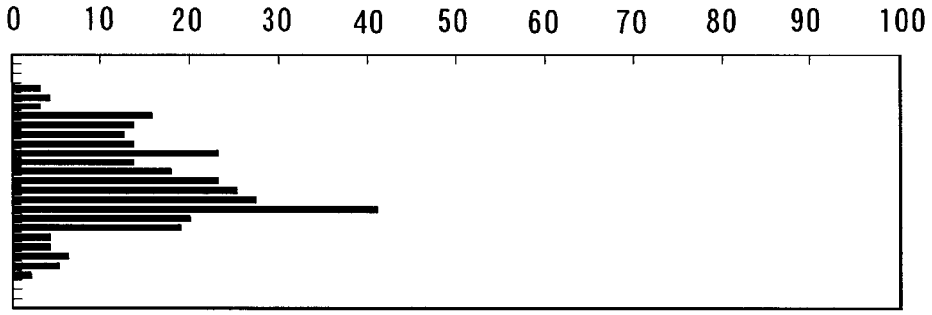
FIG. 6 is a distribution diagram showing an example of distribution of the thicknesses of a plurality of workpieces before a process using the processing apparatus according to the embodiment of the invention.
Figure 7:
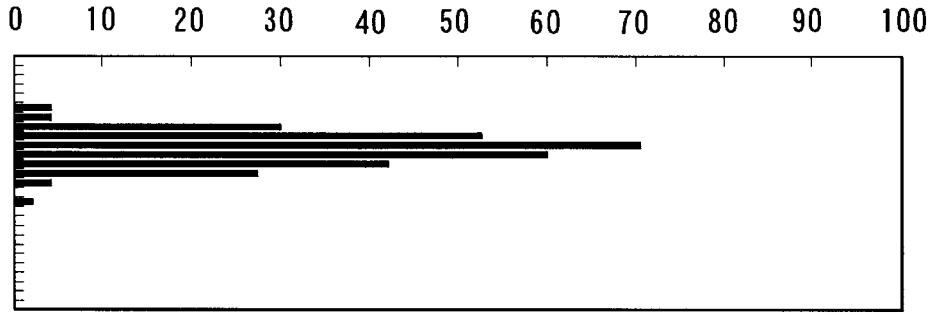
FIG. 7 is a distribution diagram showing an example of distribution of the thicknesses of the plurality of workpieces after the process using the processing apparatus according to the embodiment of the invention.

A description will now be made with reference to FIGS. 6 through 8 on a difference in distribution of thicknesses of workpieces before and after a process using the processing apparatus according to the present embodiment. FIG. 6 shows an example of distribution of the thicknesses of a plurality of workpieces before a process using the processing apparatus according to the present embodiment. FIG. 7 shows distribution of the thicknesses of the same plurality of workpieces after the process using the processing apparatus according to the embodiment. In FIGS. 6 and 7, the ordinate axis represents the thicknesses of the workpieces, and the abscissa axis represents the number of workpieces. In the case of a process performed according to a conventional method in which processing time is controlled, the distribution of the thicknesses of the workpieces after the process is similar to that shown in FIG. 6.

Figure 8:
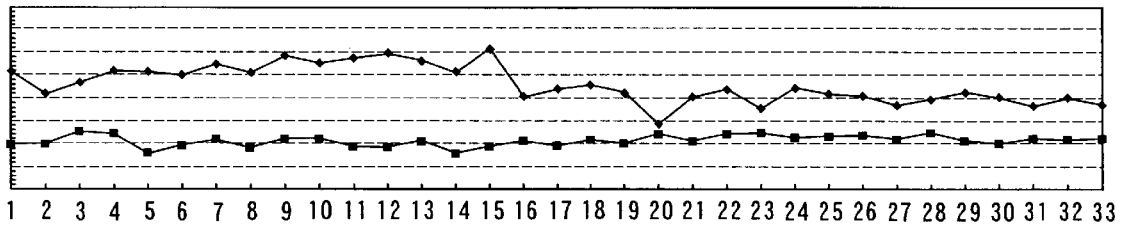
FIG. 8 is an illustration showing a comparison between the thicknesses of the plurality of workpieces before and after the process using the processing apparatus according to the embodiment of the invention.

FIG. 8 is an illustration showing a comparison between the thicknesses of the plurality of workpieces before and after the process using the processing apparatus according to the embodiment. In FIG. 8, the ordinate axis represents the thickesses of the workpieces, and the abscissa axis represents each of the workpieces. In FIG. 8, the dots in the upper part represent thicknesses before the process, and the dots in the lower part represent thicknesses after the process. It is apparent from FIGS. 6 through 8 that the processing apparatus according to the present embodiment can accurately process a workpiece such that a dimension of the workpiece becomes a desired value. According to the present embodiment, dimensional variations can be reduced to about one half of that in the case wherein processing time is controlled such that a workpiece will have a desired dimension.

The present invention is not limited to the above described embodiment and may be modified in various ways. For example, each of the first detector and second detector may have a plurality of sensors so as to detect the position from an average of values detected by the plurality of sensors.

The present invention is not limited to materials for a thin film magnetic head and may be used for processing various kinds of workpieces.

As described above, in the processing apparatus or method according to the invention, a reference position is detected by the first detector; a position associated with a dimension of a workpiece is detected by the second detector; and the dimension of the workpiece is recognized based on the positions detected by the two detectors to control the processing machine such that the dimension of the workpiece becomes a predetermined value. This makes it possible to automatically process a workpiece such that it will have a desired dimension and to improve processing accuracy and efficiency without any need for a special pre-process.

In the processing apparatus or method according to the invention, when the first detector and second detector are attached to the same arm, the first detector and second detector can be kept in a constant positional relationship. This allows an improvement of the accuracy of recognition of a dimension of a workpiece and makes it possible to improve processing accuracy further.

In the processing apparatus or method according to the invention, when a dimension of a workpiece is recognized based on the result of detection with the first detector and second detector performed plural times, it is possible to recognize the dimension of the workpiece with improved accuracy.

It is apparent from the above description that the present invention may be carried out in various modes and modifications. Therefore, the present invention may be carried out in modes other than the above-described best mode for carrying out the invention within the range of equivalence of the appended claims.

What is claimed is:

1. A processing apparatus comprising:

a processing machine which performs a predetermined process on a workpiece;

a first detector which detects a reference position;

a second detector which detects a position associated with a dimension of the workpiece which changes as a result of the process; and a controller which recognizes the dimension of the workpiece based on the reference position detected by the first detector and the position detected by the second detector and controls the processing machine such that the dimension of the workpiece becomes a predetermined value.

2. A processing apparatus according to claim 1, wherein the processing machine polishes the workpiece.

3. A processing apparatus according to claim 1, wherein the first detector and the second detector are attached to the same arm.

4. A processing apparatus according to claim 1, wherein the first detector and the second detector intermittently perform a detecting operation.

5. A processing apparatus according to claim 1, wherein the controller recognizes the dimension of the workpiece based on the result of detection performed plural times by the first detector and the second detector.

6. A processing method for processing a workpiece utilizing a processing apparatus having a processing machine which performs a predetermined process on the workpiece, a first detector which detects a reference position and a second detector which detects a position associated with a dimension of the workpiece which changes as a result of the process, the method comprising the steps of:

detecting the reference position with the first detector and detecting the position associated with the dimension of the workpiece which changes as a result of the process with the second detector;

recognizing the dimension of the workpiece based on the reference position detected by the first detector and the position detected by the second detector; and performing the process by controlling the processing machine based on the recognized dimension such that the dimension of the workpiece becomes a predetermined value.

7. A processing method according to claim 6, wherein the processing machine polishes the workpiece.

8. A processing method according to claim 6, wherein the first detector and the second detector are attached to the same arm.

9. A processing method according to claim 6, wherein the detecting step intermittently detects the positions.

10. A processing method according to claim 6, wherein the recognizing step recognizes the dimension of the workpiece based on the result of detection performed plural times by the first detector and the second detector.

* * * * *